US011432979B2

(12) United States Patent
In et al.

(10) Patent No.: US 11,432,979 B2
(45) Date of Patent: Sep. 6, 2022

(54) SMART SLING DEVICE USING PNEUMATICALLY DRIVEN GROWTH MECHANISM

(71) Applicant: KOREA INSTITUTE OF SCIENCE AND TECHNOLOGY, Seoul (KR)

(72) Inventors: Hyunki In, Seoul (KR); Keri Kim, Seoul (KR); Seung Jun Lee, Seoul (KR); Myungjoong Lee, Seoul (KR); Jeongryul Kim, Seoul (KR); Hong Jun Cho, Seoul (KR); Yong Hwan Moon, Seoul (KR); Jonggyu Choi, Naju-si (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 57 days.

(21) Appl. No.: 17/067,763

(22) Filed: Oct. 12, 2020

(65) Prior Publication Data

US 2021/0196544 A1 Jul. 1, 2021

(30) Foreign Application Priority Data

Dec. 26, 2019 (KR) ..... 10-2019-0175080

(51) Int. Cl.
*A61G 7/10* (2006.01)

(52) U.S. Cl.
CPC ..... *A61G 7/1028* (2013.01); *A61G 7/1021* (2013.01); *A61G 7/1046* (2013.01)

(58) Field of Classification Search
CPC .. A61G 7/1055; A61G 7/1057; A61G 7/1028; A61G 7/1021; A61G 7/1046
See application file for complete search history.

(56) References Cited

U.S. PATENT DOCUMENTS

| | | | |
|---|---|---|---|
| 8,204,624 | B2 | 6/2012 | Zini et al. |
| 2003/0208223 | A1 | 11/2003 | Kleiner |
| 2007/0079439 | A1 | 4/2007 | Patterson et al. |

(Continued)

FOREIGN PATENT DOCUMENTS

| | | | | |
|---|---|---|---|---|
| CN | 109549804 A | * | 4/2019 | ..... A61G 1/003 |
| EP | 2724699 A2 | | 4/2014 | |

(Continued)

OTHER PUBLICATIONS

Elliot W. Hawkes et al., "A soft robot that navigates its environment through growth," Science Robotics, 2017, pp. 1-7, vol. 2.

(Continued)

*Primary Examiner* — Peter M. Cuomo
*Assistant Examiner* — Adam C Ortiz
(74) *Attorney, Agent, or Firm* — Cantor Colburn LLP

(57) ABSTRACT

A smart sling device includes a body; a support rod installed at the body; and a sling member installed at the support rod and inserted under a patient to support the patient therebelow, and the sling member includes an expanding unit having an accommodation space for accommodating air therein, the expanding unit expanding due to a pneumatic pressure generated by the accommodated air to support the patient therebelow; and an expansion limiting unit installed at the expanding unit to limit expansion of the expanding unit in one direction.

8 Claims, 14 Drawing Sheets

(56) References Cited

U.S. PATENT DOCUMENTS

| | | | |
|---|---|---|---|
| 2017/0231846 | A1 | 8/2017 | Farrington |
| 2018/0036191 | A1 | 2/2018 | Vallejo Pineda et al. |
| 2019/0217908 | A1 | 7/2019 | Hawkes et al. |

FOREIGN PATENT DOCUMENTS

| | | | |
|---|---|---|---|
| JP | 2011-45400 | A | 3/2011 |
| JP | 2016-67752 | A | 5/2016 |
| KR | 10-2013-0103833 | A | 9/2013 |
| KR | 101626504 | B1 | 6/2016 |
| KR | 10-2017-0020029 | A | 2/2017 |
| WO | 2007044231 | A2 | 4/2007 |
| WO | 2009131818 | A2 | 10/2009 |

OTHER PUBLICATIONS

Muscle Corporation, "Sasuke" (https://www.musclerobo.com/).
Korean Notice of Allowance for KR Application No. 10-2019-0175080 dated Jan. 17, 2022 citing the above reference(s).

* cited by examiner

SMART SLING DEVICE USING PNEUMATICALLY DRIVEN GROWTH MECHANISM

CROSS-REFERENCE TO RELATED APPLICATION

This application claims priority to Korean Patent Application No. 10-2019-0175080, filed on Dec. 26, 2019, and all the benefits accruing therefrom under 35 U.S.C. § 119, the contents of which in its entirety are herein incorporated by reference.

BACKGROUND

1. Field

The present disclosure relates to a smart sling device, and more particularly, to a smart sling device using a pneumatically driven growth mechanism.

EXPLANATION OF NATIONAL RESEARCH AND DEVELOPMENT SUPPORT

This research is supervised by Man&Tel Co., Ltd., and supported by the research and development of common product technology for caring robots (R&D) (people-centered smart two-armed transfer assistant robot development No. 1415163820), Korea Institute of Industrial Technology Evaluation and Management, Ministry of Commerce, Industry and Energy, Korea (Republic of Korea).

2. Description of the Related Art

A conventional patient transfer assist device has a structure using a sling in consideration of the safety and comfort of the patient. However, the sling is not actively used in the care field because it requires a lot of labor and time to insert or remove the sling under the patient.

Meanwhile, since the conventional growth mechanism is manufactured using only a flexible layer, the growth mechanism expands isotropically by pneumatic pressure to have a circular cross section. Thus, the growth mechanism should have a great height so as to be inserted into a gap in a large area. Also, since the growth mechanism does not have a flat structure, the growth mechanism cannot guarantee stability if it is used for lifting an object.

In addition, since the growth mechanism has a circular cross section, if a pneumatic pressure is applied to a large area by using the growth mechanism alone, the height is excessively increased. Thus, it is somewhat difficult to apply the growth mechanism to a patient transfer assistance device for lifting a person.

SUMMARY

The present disclosure is directed to providing a smart sling device, which may automatically and comfortably insert a sling to support a patient.

In addition, the present disclosure is also directed to providing a smart sling device, which may be applied to applications requiring stability, such as lifting a patient, because it is expandable to have a wide and low cross section.

Meanwhile, the present disclosure is also directed to providing a smart sling device, which may be easily inserted under a person with a single wide sheet structure.

In order to solve the above problem, a smart sling device of the present disclosure comprises a body; a support rod installed at the body; and a sling member installed at the support rod and inserted under a patient to support the patient therebelow, wherein the sling member includes an expanding unit having an accommodation space for accommodating air therein, the expanding unit expanding due to a pneumatic pressure generated by the accommodated air to support the patient therebelow; and an expansion limiting unit installed at the expanding unit to limit expansion of the expanding unit in one direction.

In an example related to the present disclosure, two support rods may be provided so that the expanding unit is installed at one support rod and expands toward the other support rod by the pneumatic pressure.

In another example related to the present disclosure, the expansion limiting unit may be installed at the expanding unit in a direction intersecting with the one direction.

In still another example related to the present disclosure, the expansion limiting unit may be provided in plural, and the plurality of expansion limiting units may be installed at the expanding unit in parallel with each other.

Preferably, the expansion limiting unit may be respectively installed at one surface of the expanding unit that is contactable with the patient and the other surface thereof opposite to the one surface with the accommodation space being interposed therebetween.

Preferably, the expansion limiting unit may be installed at a side surface of the expanding unit that is connected to the one surface.

In still another example related to the present disclosure, the expanding unit may have first and second portions formed at a front side thereof to convexly protrude in an expanding direction.

In still another example related to the present disclosure, a tension transmission member may be installed inside the expanding unit to generate a tension so as to lift the patient after the expanding unit completely expands.

In still another example related to the present disclosure, a tension transmission member may be installed at an outer side of the expanding unit so that the tension transmission member applies a tension to the expanding unit when the expanding unit expands.

Since the expansion limiting unit is installed at the expanding unit, the smart sling device of the present disclosure may prevent, for example, expansion in a vertical direction and thus may be inserted in a state where a patient is lying comfortably.

In addition, the smart sling device of the present disclosure may remove or automate a smart sling by reversely operating the growth mechanism by removing the pneumatic pressure applied to the expanding unit.

DETAILED DESCRIPTION

Hereinafter, the embodiments disclosed in this specification will be described in detail. Here, identical or similar components are denoted by identical or similar reference symbols and not described in detail again. In the following description, the word "unit" used in terms is selected or endowed only in consideration of ease naming and does not have any distinguishable meaning or role. In addition, in the following description of the embodiments of the present disclosure, any detailed description of related arts can be omitted if it is determined that the gist of the embodiments disclosed herein can be obscured by the same. Moreover, it should be understood that the accompanying drawings are just for better understanding of the embodiments disclosed herein and are not to be construed as limiting the scope of the present disclosure. The scope of the present disclosure should be understood as including all changes, equivalents and alternatives thereof.

Terms having an ordinal such as "first" and "second" can be used for explaining various components, but the components are not limited by the terms. These terms are just used for distinguishing any component from another.

In case it is mentioned that any component is "connected" to another component, the component may be connected directly to another component, but it should be understood that any other component can be further interposed between them.

The singular expressions are intended to include the plural forms as well, unless the context clearly indicates otherwise.

In this specification, the term such as "include" and "have" is just to specify the presence of features, integers, steps, operations, elements, parts or components thereof, stated in the specification, but does not preclude the presence or addition of one or more other features, integers, steps, operations, elements, parts or components thereof.

First, a smart sling device 100 of the present disclosure of the present disclosure will be described with reference to FIGS. 1 to 5.

Figure 1:
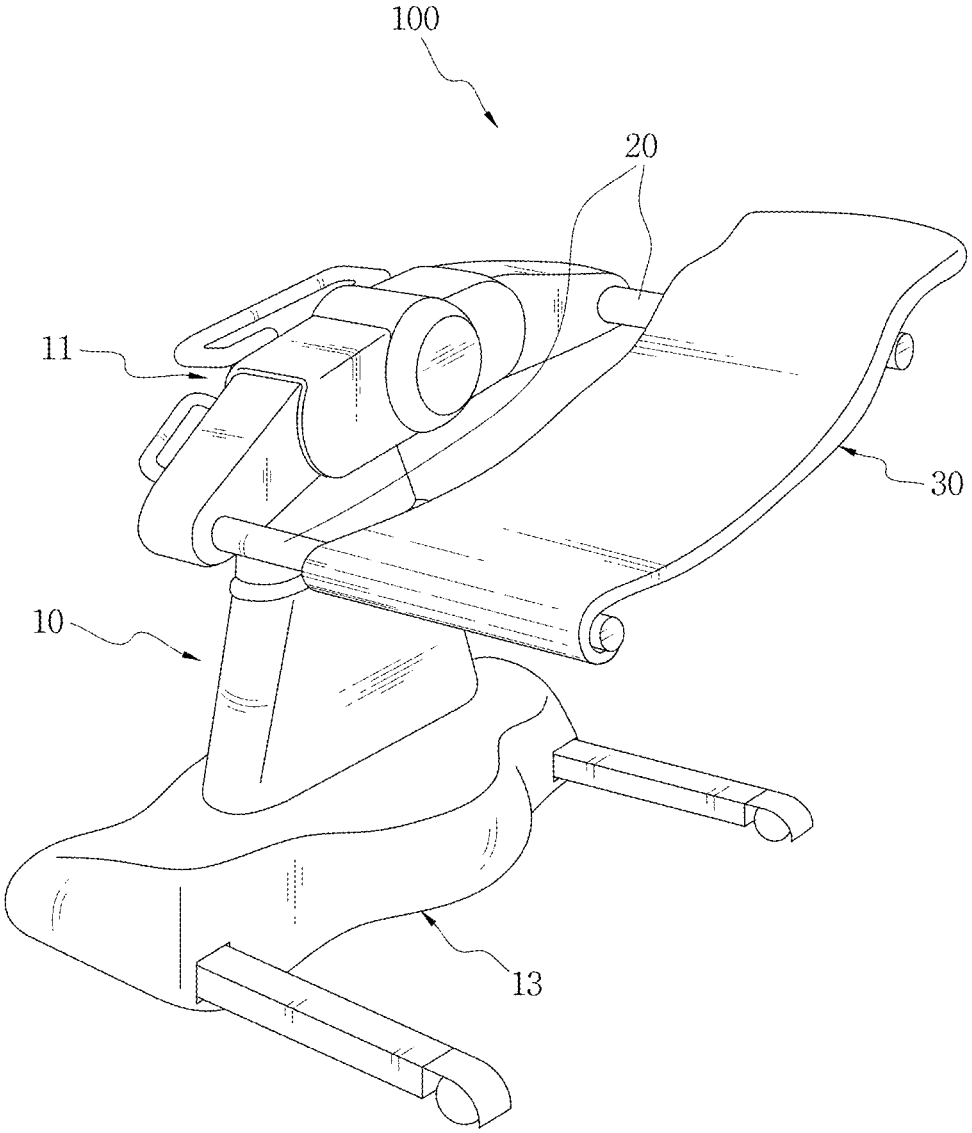
FIG. 1 is a perspective view showing an example of a smart sling device of the present disclosure.

Referring to FIG. 1, the smart sling device 100 of the present disclosure includes a body 10, a support rod 20, and a sling member 30.

The support rod 20 and the sling member 30 are installed at the body 10. The body 10 may include a manipulation unit 11 manipulated by a caregiver or manager to operate the support rod 20 or the sling member 30, and a base unit 13 configured to form a base of the body 10 to support the manipulation unit 11, the support rod 20 and the sling member 30.

The manipulation unit 11 is configured to allow the entire body 10 to move and rotate in front, rear, left and right directions. The manipulation unit 11 may move each support rod 20 vertically and move the support rod 20 away from a patient (to remove the support rod 20), and this will not be described in detail.

In addition, the body 10 may have a sensor (not shown) capable of recognizing the surrounding environment, and by recognizing the surrounding situation by the sensor, it is possible to automatically stop the operation when an unexpected situation occurs.

The support rod 20 is installed at the body 10. The support rod 20 may be disposed at one surface of the body 10 to protrude to the maximum, and the position of the support rod 20 may be changed such that the sling member 30 may be easily folded or removed by protruding only by a predetermined length rather than protruding to the maximum.

For example, two support rods 20 may be provided.

Figure 5:
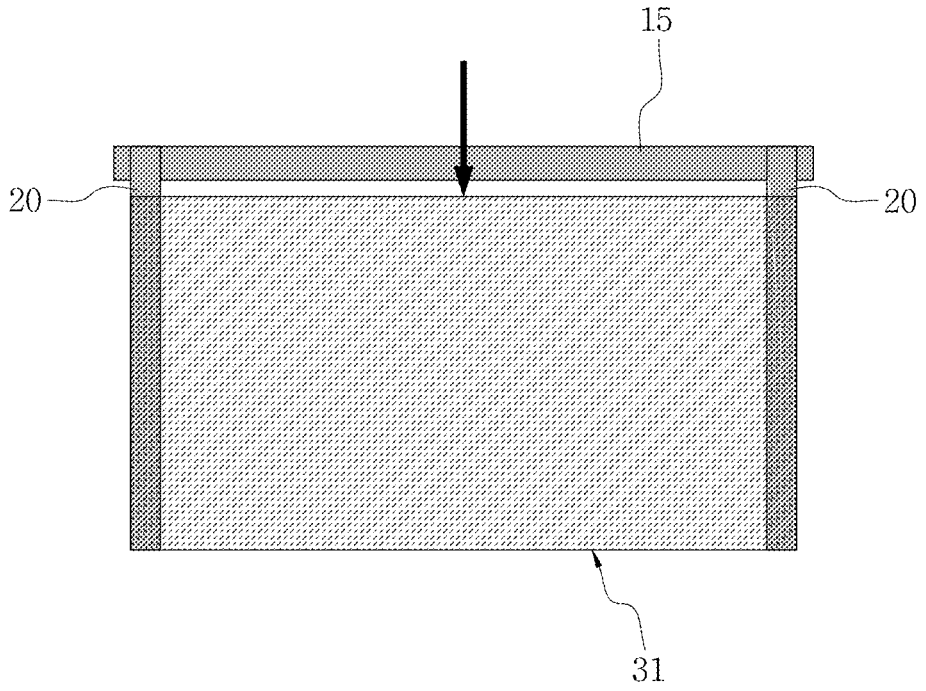
FIG. 5 is a plan view showing another example of the smart sling device of the present disclosure.

Meanwhile, the support rod 20 may be movably coupled to a support member 15 (FIG. 5).

The sling member 30 is installed at the support rod 20, and may be inserted under the patient to lift the patient.

The sling member 30 includes an expanding unit 31 and an expansion limiting unit 35.

The expanding unit 31 has an accommodation space 32 for accommodating air therein, and is expanded by a pneumatic pressure caused by the accommodated air.

In this specification, the expanding unit 31 is based on a structure that everts from the inside to the outside when a pneumatic pressure is applied to the accommodation space 32, and the expanding unit 31 may be rolled inward before the pneumatic pressure is applied to the accommodation space 32. The expanding unit 31 may be understood as a growth mechanism.

As the accommodation space 32 expands by a pneumatic pressure, the expanding unit 31 may be easily inserted without applying a force to a narrow gap between the patient and the bed.

Figure 2A:
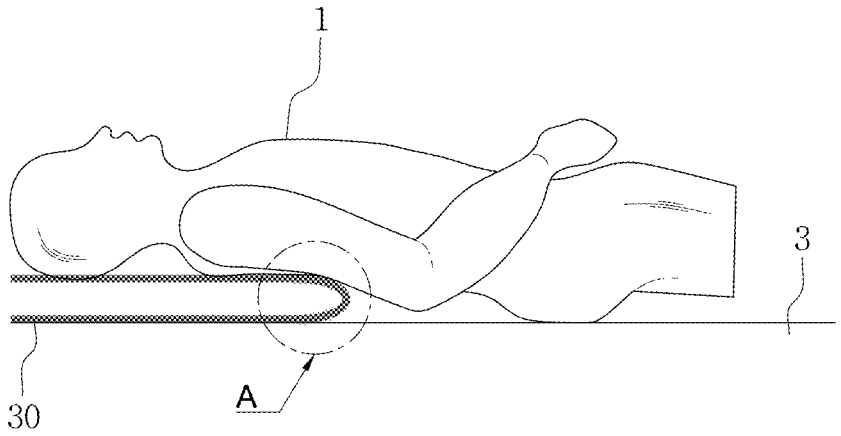
FIGS. 2A to 2C are diagrams showing an example in which an expanding unit expands under a patient.
Figure 2B:
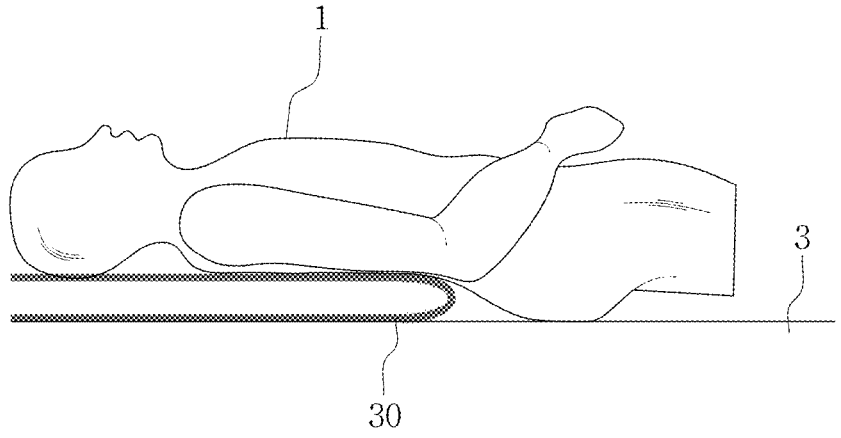
Figure 2C:
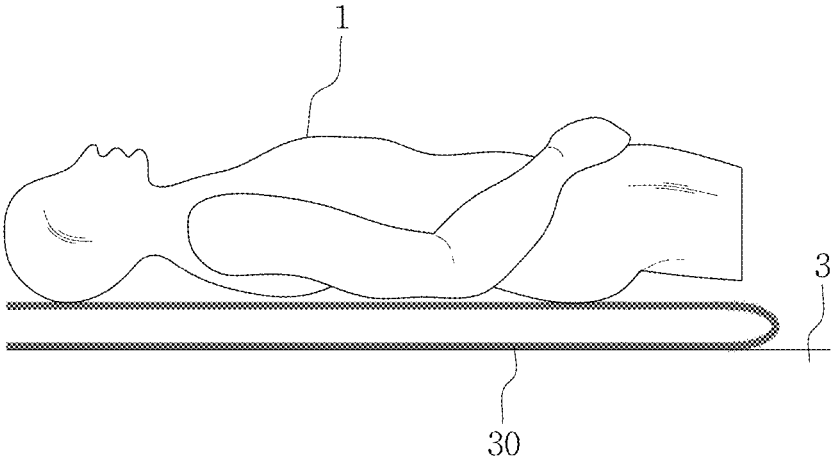

Referring to FIGS. 2A to 2C, an example in which the expanding unit 31 expands in the narrow gap between the patient and the bed and is inserted in a height direction of the patient is shown. In addition, FIG. 3 is an enlarged view showing a portion A of FIG. 2A, and referring to FIG. 3, an example in which the expanding unit 31 expands by a pneumatic pressure inside the accommodation space 32 to create a gap between the patient 1 and the bed 3 and is inserted into the gap is shown.

Figure 3:
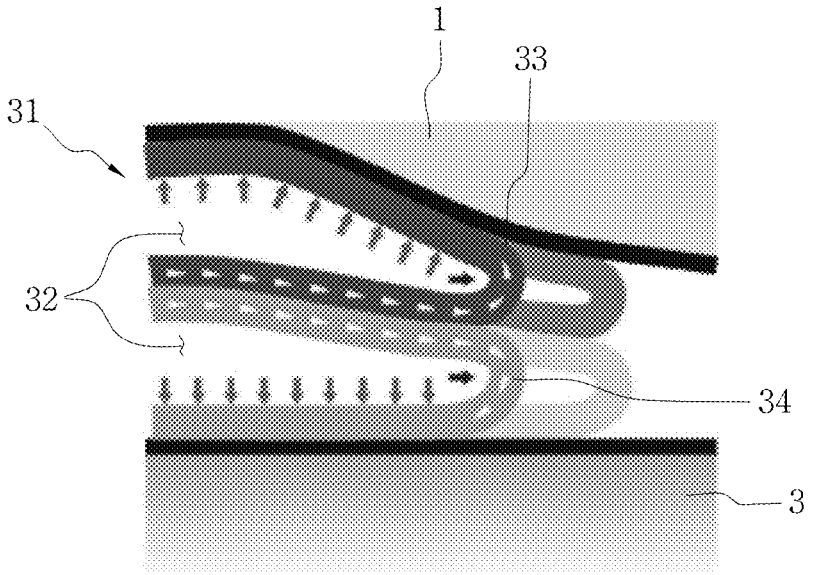
FIG. 3 is an enlarged view showing a portion A of FIG. 2A.
Figure 4A:
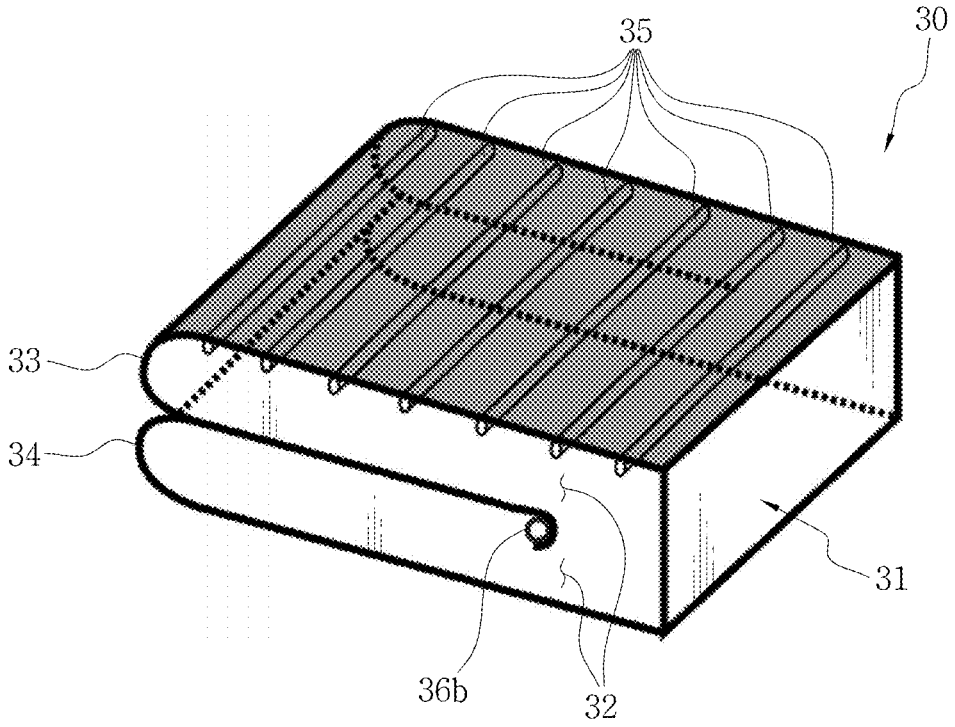
FIG. 4A is a perspective view showing an example of a sling member.
Figure 4B:
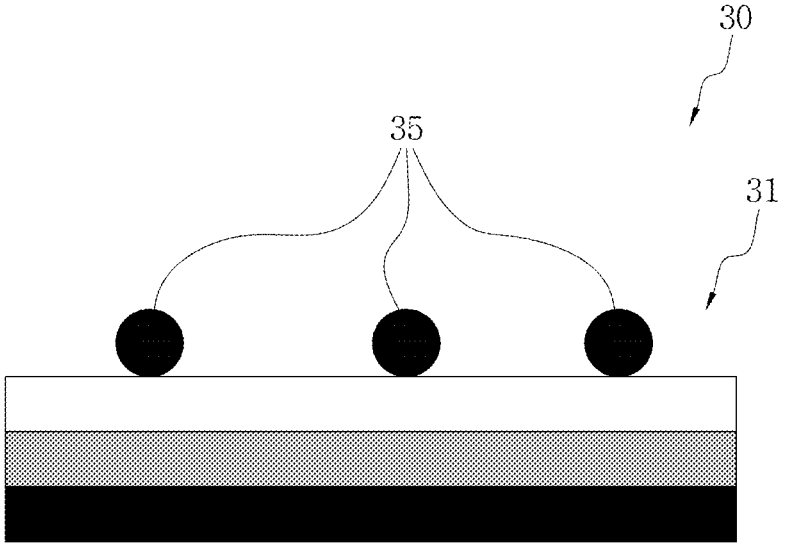
FIG. 4B is a sectional view showing an example in which an expansion limiting unit is installed at the expanding unit.

In addition, referring to FIGS. 3 and 4A, the expanding unit 31 may have first and second portions 33, 34 at the front thereof in an expanding direction, and the first and second portions 33, 34 may be shaped to convexly protrude, respectively.

In addition, the expanding unit 31 may allow the sling member 30 to be removed by eliminating the air in the accommodation space 32, which may be understood as operating the growth mechanism in reverse.

As an example, if two support rods 20 are provided, the expanding unit 31 may be installed between the two support rods 20.

The expanding unit 31 should have a sealable structure such that air is accommodated in the accommodation space 32 to apply a pneumatic pressure.

Since the expanding unit 31 does not cause slip or relative motion with respect to the external environment, there is no need to reduce friction not to apply force to the external environment, and the external structure of the expanding unit 31 is preferably formed to have a high friction to prevent a user from slipping. In addition, it is preferable that the internal structure of the expanding unit 31 is formed to have a low friction structure so that the entire expanding unit 31 is operated well.

In addition, as shown in FIG. 4A, an external shaft 36*b* may be connected to the expanding unit 31 to wind the connected expanding unit 31, the external shaft 36*b* is connected to a motor that provides power, so as to pull the expanding unit 31 inward. The pneumatic pressure provided to the inside of the expanding unit 31 and the rotation of the external shaft 36*b* are controlled to extrude the internal structure of the expanding unit 31 so that the length of the expanding unit 31 is increased, or the external structure is introduced therein to shorten the length of the expanding unit 31.

For example, the expanding unit 31 may be made of vinyl.

While the inner layer of the expanding unit 31 is everted outward, if the size of the structure extruded from the inside is identical to or larger than the outer structure, the inner structure of the expanding unit 31 generates friction while moving to the outside, which interferes with the operation.

Such a structure is identically applied when the outer structure of the expanding unit 31 is rolled inward, so it is preferable that the structure of the expanding unit 31 rolled inward is made to be smaller than the outer structure.

Figure 4C:
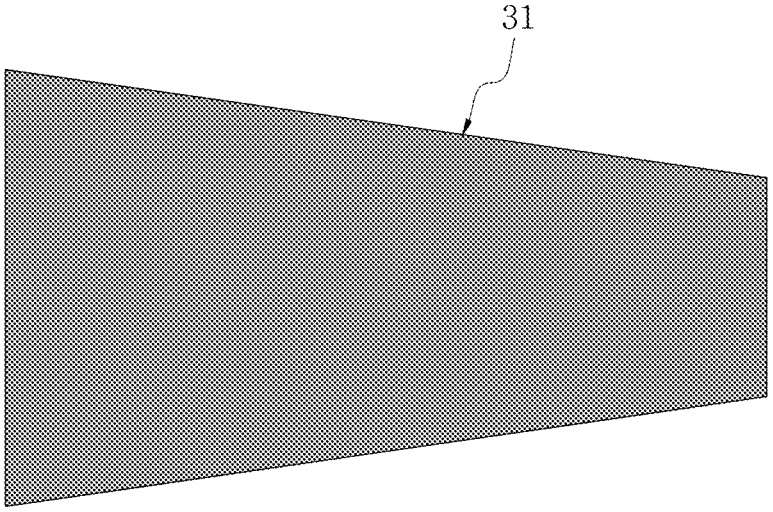
FIG. 4C is a plan view showing an example in which a portion of the expanding unit rolled inward is formed smaller than an outer portion thereof.

FIG. 4C conceptually shows the expanding unit 31 that is everted outward, and an example in which a right end of the expanding unit 31 inserted inward has a smaller width than a left end thereof is shown.

As shown in FIG. 4C, If the width of the expanding unit 31 at the right end is smaller than that at the left end, the support rod 20 installed at the right end of the expanding unit 31 may also have a smaller length than the support rod 20 installed at the left end of the expanding unit 31.

Figure 4D:
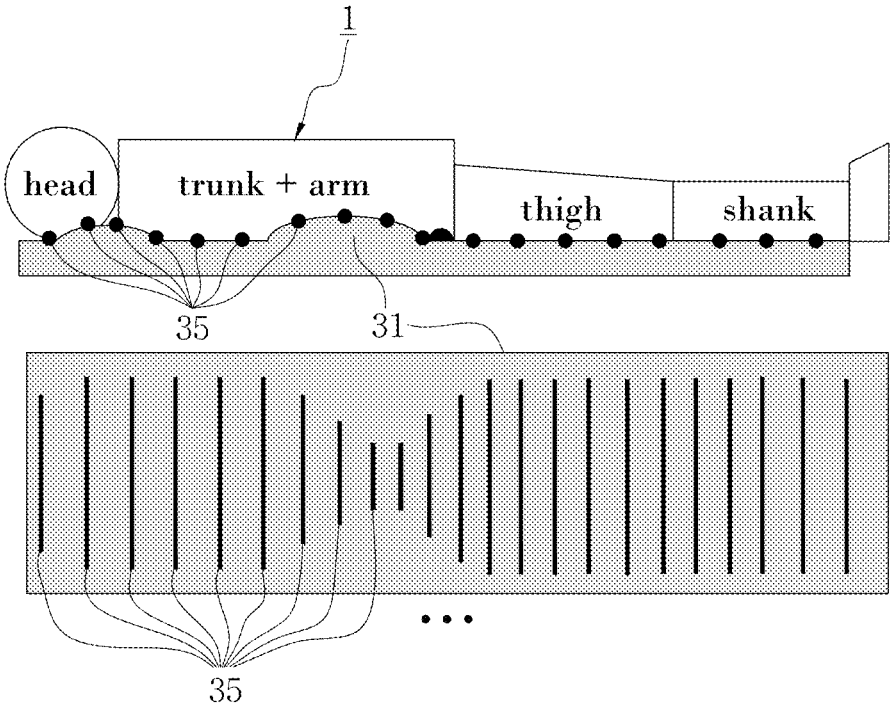
FIG. 4D is a diagram view showing an example in which some of a plurality of expansion limiting units have different lengths so as to expand suitable for a curve of a human body.
Figure 4E:
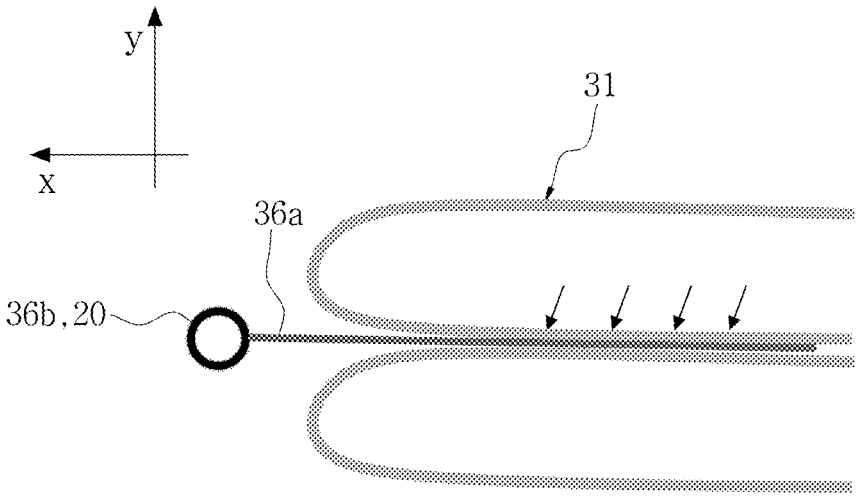
FIG. 4E is a sectional view showing an example in which a tension transmission member is installed at the expanding unit.

Meanwhile, referring to FIG. 4E, the expanding unit 31 may include a tension transmission member 36*a* installed between the first and second portions 33, 34 of the expanding unit 31 and an external shaft 36*b* configured to support the tension transmission member 36*a*. The tension transmission member 36*a* may be disposed along a direction in which the expanding unit 31 expands, and one end of the tension transmission member 36*a* may be fixed to the external shaft.

The tension transmission member 36*a* should have a structure capable of receiving and supporting a tension.

For example, the tension transmission member 36*a* may be a belt, cable or strap.

The tension transmission member 36*a* may be installed inside or outside the expanding unit 31.

The tension transmission member 36*a* has two main functions. First, if the tension transmission member 36*a* is disposed out of the expanding unit 31, when the expanding unit 31 is everted, the tension transmission member 36*a* gives a pulling force by applying a tension to help the eversion and smooth growth. Second, the belt structure disposed inside the expanding unit 31 may generate and support a tension when lifting the patient after the expanding unit 31 completely expands.

The external shaft 36*b* may be one of the support rods 20, or may be provided separately from support rods 20. The insertion force of the expanding unit 31 between the patient and the bed may be further improved by the tension transmission member 36*a* and the external shaft 36*b*.

The expansion limiting unit 35 is installed at the expanding unit 31 to limit the expansion of the expanding unit 31 in one direction.

The one direction is a direction in which the patient is looking at when the patient is lying on the bed. In FIGS. 2A to 2C, the one direction is an upward direction in which the patient 1 lying on the bed 3 is looking at. The one direction may be a direction intersecting with the height direction of the patient 1, and may be understood as a direction intersecting with the direction in which the expanding unit 31 expands.

Since the expansion limiting unit 35 limits the expansion of the expanding unit 31 in one direction, the expanding unit 31 is allowed to make anisotropic expansion. The expansion unit 31 expands anisotropically by a pneumatic pressure and is easily inserted into the narrow gap between the patient and the bed to support the patient without applying a force.

In addition, since the expansion limiting unit 35 limits the expansion of the expanding unit 31 in one direction, the expanding unit 31 may be inserted into the narrow gap between the patient and the bed and support the patient while maintaining a predetermined width.

FIGS. 2A to 2C show an example in which the expanding unit 31 expands while maintaining a predetermined width to expand near the head toward the leg.

The expansion limiting unit 35 may be installed at the expanding unit 31 in a direction intersecting with the one direction.

In addition, the expansion limiting unit 35 may be provided in plural, and the plurality of expansion limiting units 35 may be installed at the expanding unit 31 in parallel with each other.

FIG. 4A shows an example in which the plurality of expansion limiting units 35 are installed at an upper surface of the expanding unit 31 in parallel with each other. Here, even though air is introduced into the accommodation space 32 of the expanding unit 31, the expansion limiting unit 35 limits the expansion of the expanding unit 31 in the upward direction while one surface of the expanding unit 31 at which the expansion limiting unit 35 is installed is maintained in the longitudinal direction along with the expansion limiting unit 35.

Meanwhile, slightly different from FIG. 4A, the expansion limiting unit 35 may be installed not only at one surface of the expanding unit 31, which is contactable with the patient, but also at the other surface thereof opposite to the one surface.

One surface of the expanding unit 31 may be an upper surface that is capable of contacting the patient and at which the expansion limiting unit 35 is installed in FIG. 4A, and the other surface of the expanding unit 31 may be a lower surface of the expanding unit 31 in FIG. 4A.

The expansion limiting unit 35 may be installed at the expanding unit 31 by an adhesive tape, but is not necessarily limited to this installation type.

If the expansion limiting unit 35 is installed at the upper and lower surfaces of the expanding unit 31 as above, the sling member 30 may be inserted from the knee or head of the patient along the height direction of the patient. Preferably, the sling member 30 is inserted toward the knee of the patient and expanded to extend to the top of the head of the patient along the height direction.

Since the expanding unit 31 does not expand isotropically by the expansion limiting unit 35, the expanding unit 31 may be easily inserted under the patient in one wide seat structure.

Meanwhile, the expansion limiting unit 35 may be installed at a side surface of the expanding unit 31 that is connected to the one surface.

Figure 7A:
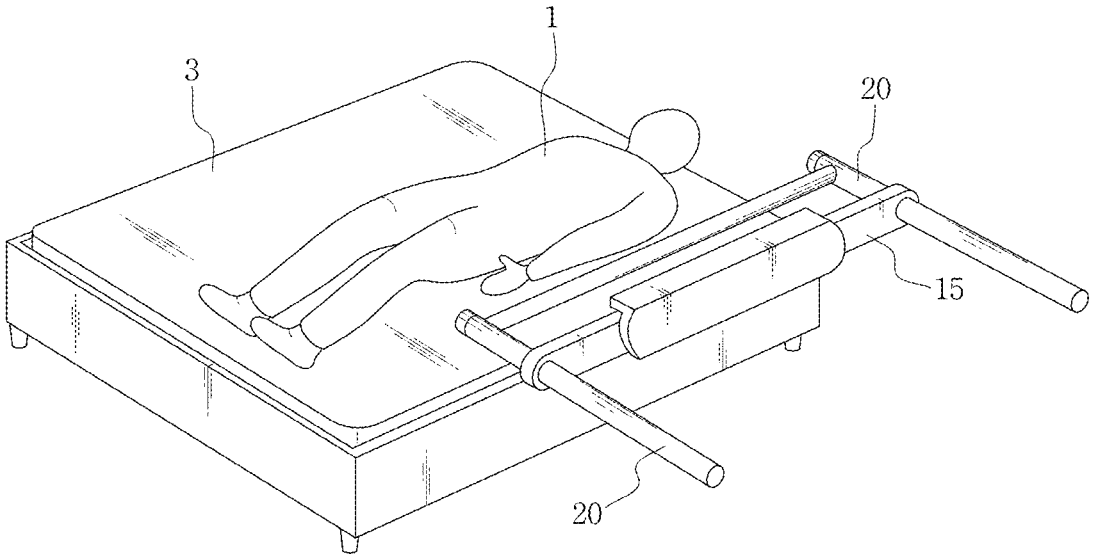
FIGS. 7A to 7C are diagrams showing an example in which the expanding unit expands in a lateral direction of the patient and is inserted under the patient.
Figure 7B:
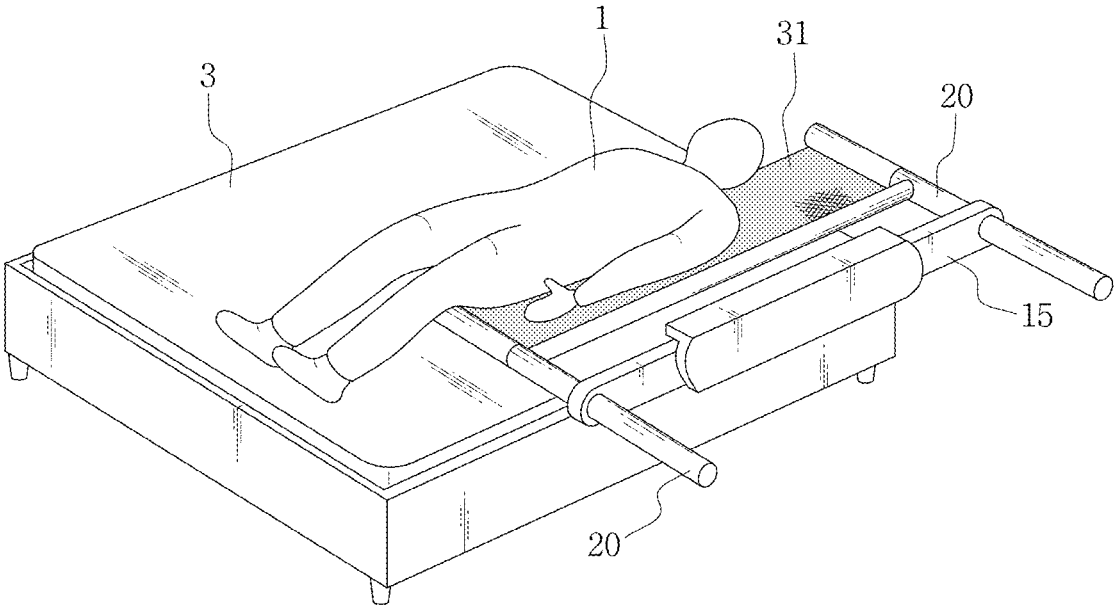
Figure 7C:
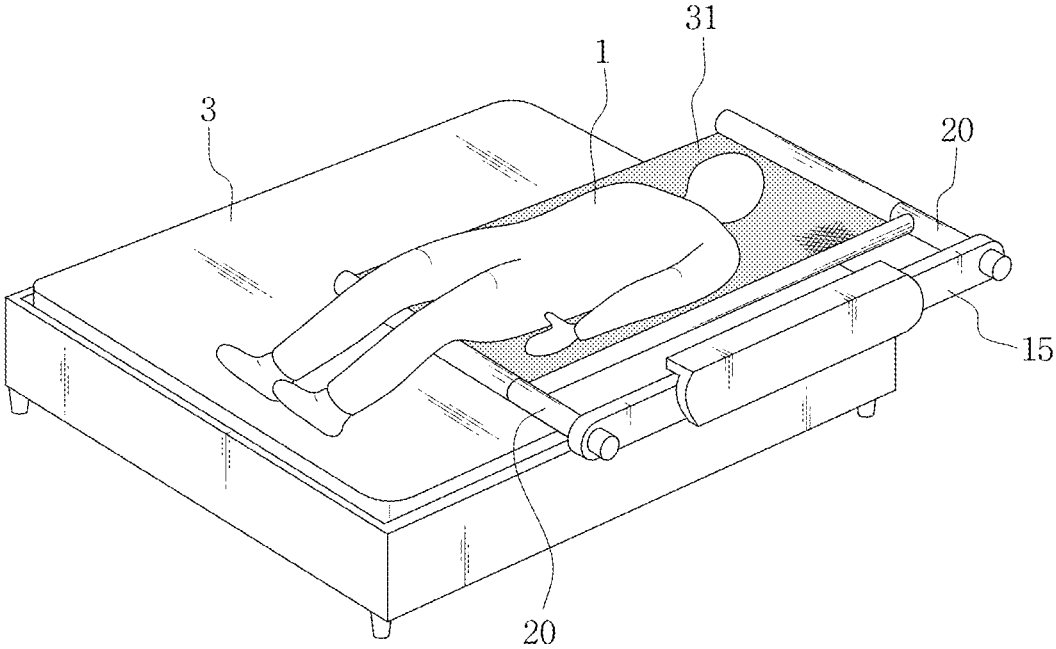

If the expansion limiting unit 35 is installed at the side surface of the expanding unit 31 that is connected to the upper surface thereof, the sling member 30 may be inserted from the side of the patient. Referring to FIGS. 7A to 7C, the expanding unit 31 installed at the two support rods 20 is expanded so that the sling member 30 is inserted toward the knee of the patient 1 and extends to the top of the head of the patient along the height direction.

Referring to FIG. 4D, it is depicted that among the plurality of expansion limiting units 35, some expansion limiting units 35 have lengths gradually decreasing from the shoulder and back of the patient 1 toward the waist of the patient and gradually increasing again from the waist of the patient toward the thigh of the patient.

In FIG. 4D, since some of the plurality of expansion limiting units 35 have different lengths, the height of the expanding unit 31 may be adjusted in consideration of the curve of the human body to have the expansion structure suitable for the curve of the human such that a region near the waist is designed to be high and a region near the shoulder portion is designed to be low.

For example, the expansion limiting unit 35 may be a shaft having sufficient rigidity to prevent expansion in one direction.

In this way, the sling member 30 has a structure that may lift the patient using a pneumatic pressure to form a gap between the patient and the area on which the patient is lying, and be inserted into the gap. The sling member 30 may be a growth mechanism.

The growth mechanism has a structure with a circular cross section because it has the characteristic of expanding isotropically by a pneumatic pressure. In addition, if the sling is designed to have a great width, the height of the sling is increased, and the side of the sling supporting the patient has a raised shape, which makes it impossible to stably support the patient.

However, since the expansion limiting unit 35 is installed at the expanding unit 31, the smart sling device 100 of the present disclosure may be inserted in a state where the patient is lying comfortably by preventing expansion in, for example, the vertical direction.

In other words, since a pushing force is not generated to the patient and the area where the patient is lying, the smart sling device 100 may be conveniently and comfortably inserted under the patient.

In addition, the smart sling device 100 of the present disclosure may operate the growth mechanism in reverse by removing the pneumatic pressure applied to the expanding unit 31, thereby enabling removal or automation of the smart sling.

Meanwhile, the present disclosure uses a useful mechanism, called a growth mechanism, which is not commonly used in the art, and as described above, in the smart sling device 100 of the present disclosure, the expanding unit 31 may be configured as the growth mechanism structure. If a conventional pneumatic pressure tube is inserted under a person by expanding, a relative motion is generated between the person and the pneumatic pressure tube due to the expansion, and accordingly the pneumatic pressure tube is inserted while pushing the surrounding environment such as bed sheet.

If the expansion method of the conventional pneumatic pressure tube is used, the person is pushed, which results in deteriorated stability, difficulty in insertion and an increased risk of injury caused by the pushing force. Also, if the bed sheet is pushed, the person feels uncomfortable when lying down thereon, so the bed sheet should be rearranged again.

In the present disclosure, since the growth mechanism expands as the internal structure thereof is being pushed out, a relative motion with the surrounding environment is not generated, so the above problems do not occur.

In the case of the conventional general pneumatic pressure tube, isotropic expansion may be prevented by adding a simple internal structure, but it is not impossible to add an internal structure in order to form a structure that is rolled to the inside of the growth mechanism. For this reason, the present disclosure using the growth mechanism is designed.

Figure 6A:
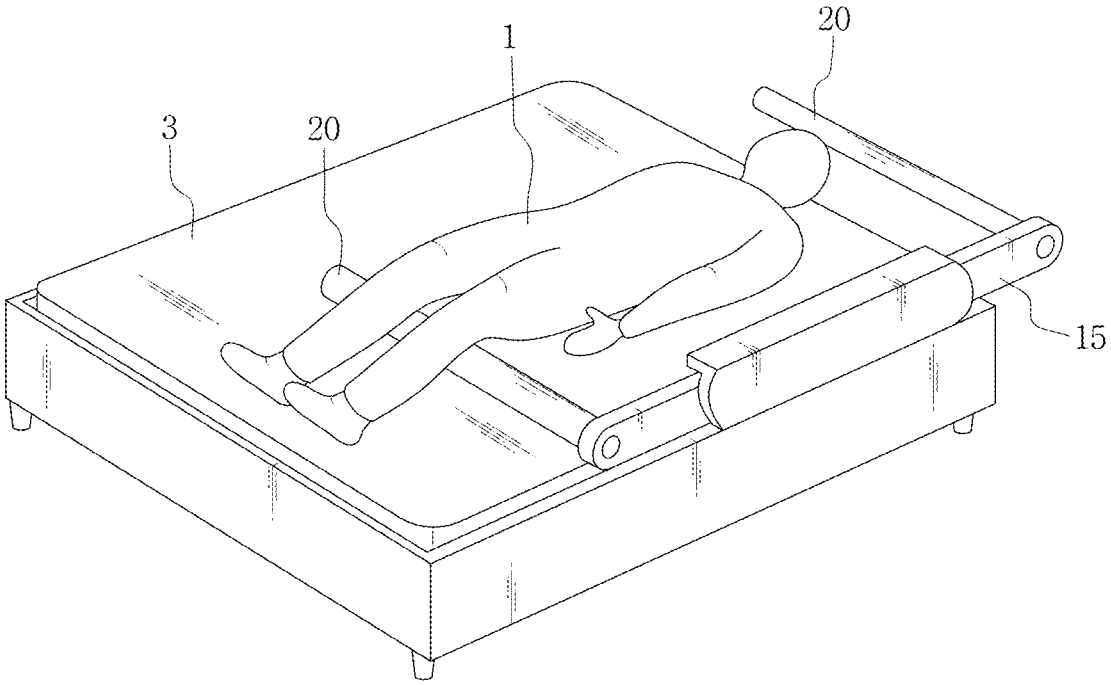
FIGS. 6A to 6C are diagrams showing an example in which the expanding unit expands in a height direction of the patient and is inserted under the patient.
Figure 6B:
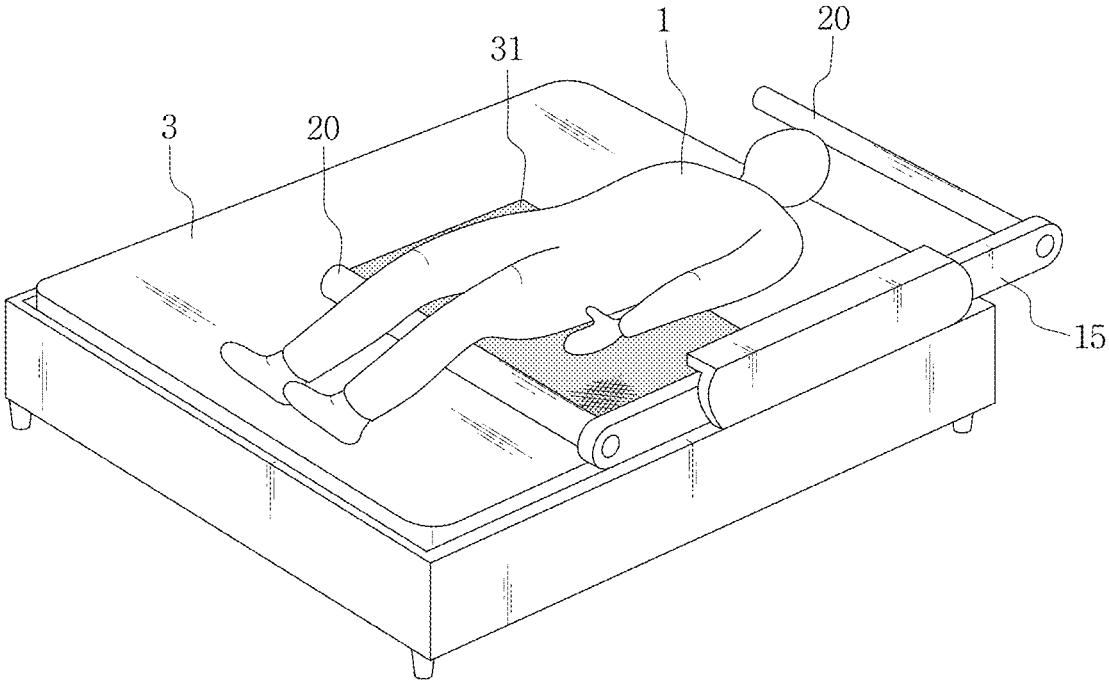
Figure 6C:
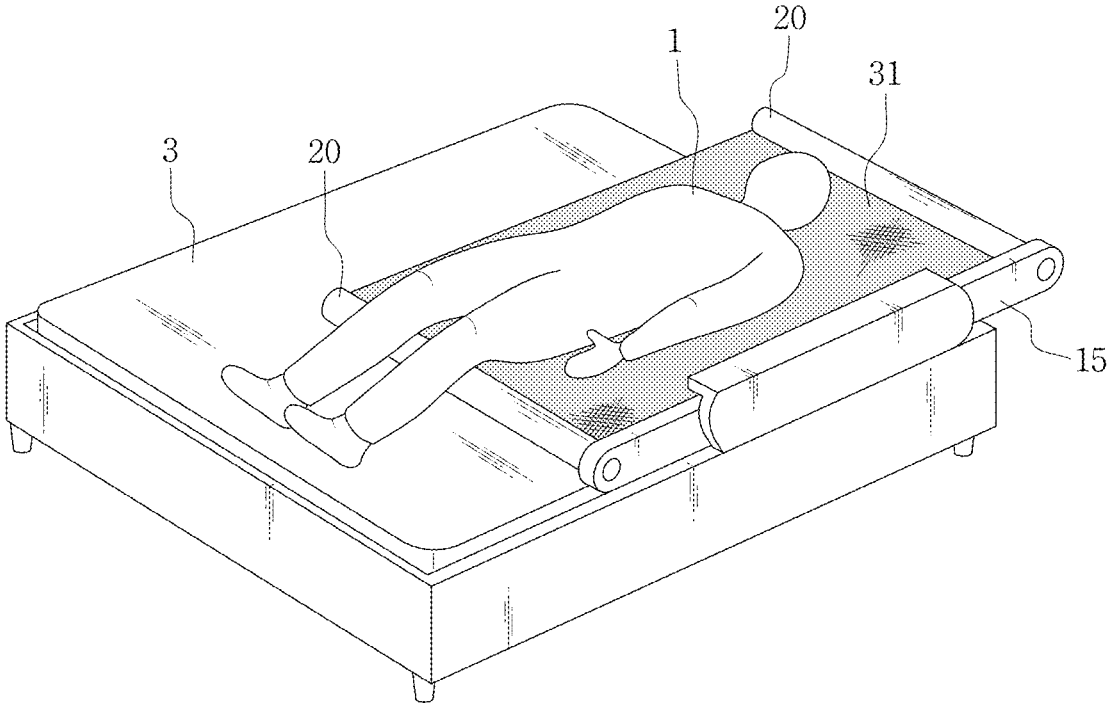

FIGS. 6A to 6C show an example in which the expanding unit 31 of the smart sling device 100 of the present disclosure expands in the height direction of the patient to support the patient.

FIG. 6A shows a state before a pneumatic pressure is applied to the expanding unit 31, at which the expanding unit 31 is not yet expanded. FIG. 6B shows a state in which the expanding unit 31 is expanded in the height direction of the patient 1 by applying a pneumatic pressure, and FIG. 6C shows a state in which the expanding unit 31 is expanded to the maximum so that the patient 1 is supported by the expanding unit 31 and the support rod 20 near the leg of the patient.

In the state of FIGS. 6A to 6C, it is preferable that expansion limiting units 35 are disposed at the upper and lower surfaces of the expanding unit 31, respectively. In addition, FIGS. 6A to 6C show an example in which the expanding unit 31 is rolled on the support rod 20 near the knee of the patient 1 and expands toward the support rod 20 near the head. However, without being limited thereto, it is also possible that the expanding unit 31 is rolled on the support rod 20 near the head and expands toward the support rod 20 near the knee.

FIGS. 7A to 7C show an example in which the expanding unit 31 of the smart sling device 100 of the present disclosure expands between the patient 1 and the bed 3 toward the side of the patient 1 to support the patient 1.

FIG. 7A shows a state before the pneumatic pressure is applied to the expanding unit 31, at which the expanding unit 31 is not yet expanded. FIG. 7B shows a state in which the expanding unit 31 is expanded between the patient 1 and the bed 3 toward the side of the patient 1 by applying the pneumatic pressure. FIG. 7C shows a state in which the expanding unit 31 is expanded to the maximum so that the patient 1 is supported by the expanding unit 31 and the support rod 20 near the leg.

In the state of FIGS. 7A to 7C, the expansion limiting unit 35 may be disposed at the side of the expanding unit 31, and preferably, the expansion limiting unit 35 may be respectively disposed at the two sides of the expanding unit 31 where the two support rods 20 are located.

FIGS. 7A to 7C show an example in which the support rod 20 is installed to be movable with respect to the support member 15, and in a state where the expanding unit 31 is expanded to the maximum toward the side of the patient 1, the support rod 20 protrudes to the maximum from the support member 15.

Referring to FIGS. 8A to 8E, an example in which the patient 1 is transferred from the bed 3 to a wheelchair 7 by operating the smart sling device 100 of the present disclosure will be described.

Figure 8A:
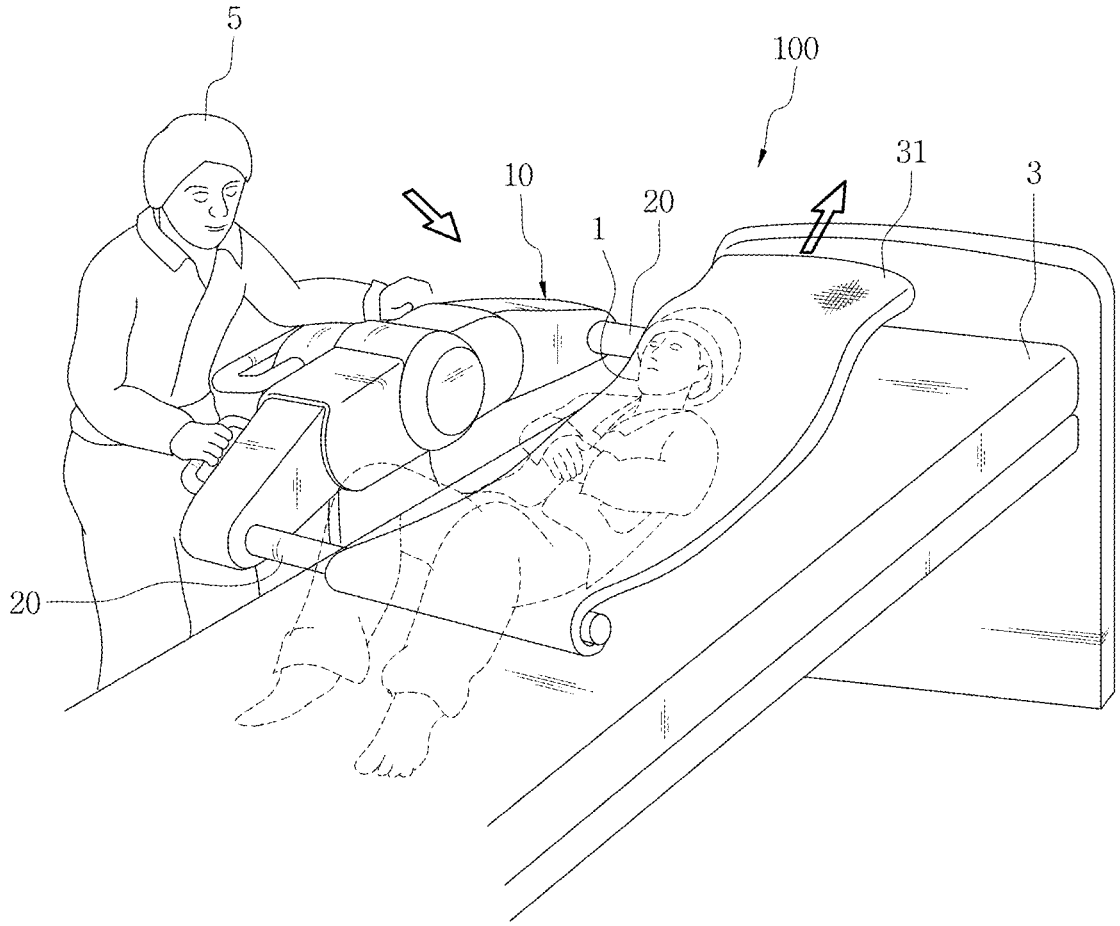
FIG. 8A is a diagram showing an example in which a support rod and a sling member are disposed under the patient.

Referring to FIG. 8A, the smart sling device 100 approaches to the side of the patient 1 who is lying so that the sling member 30 and the support rod 20 are inserted under the leg, and then the sling member 30 is deployed to be inserted under the patient 1 and connected to the support rod 20 above the head.

Figure 8B:
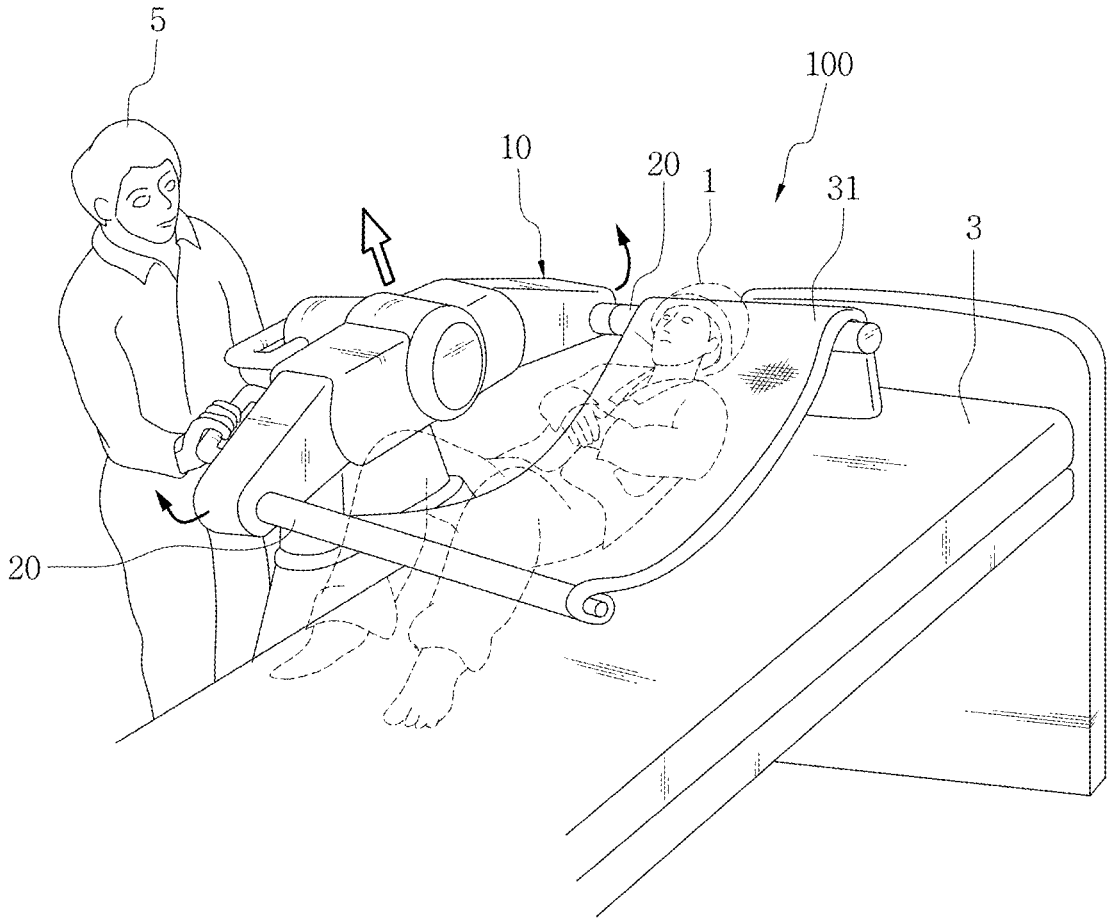
FIG. 8B is a diagram showing an example in which the support rod moves up to lift the patient.

Referring to FIG. 8B, if a caregiver 5 holds a manipulation handle of the body 10 and applies a force upward with the intention of lifting the patient 1, the support rod 20 rises to lift the patient 1 supported by the sling member 30.

Figure 8C:
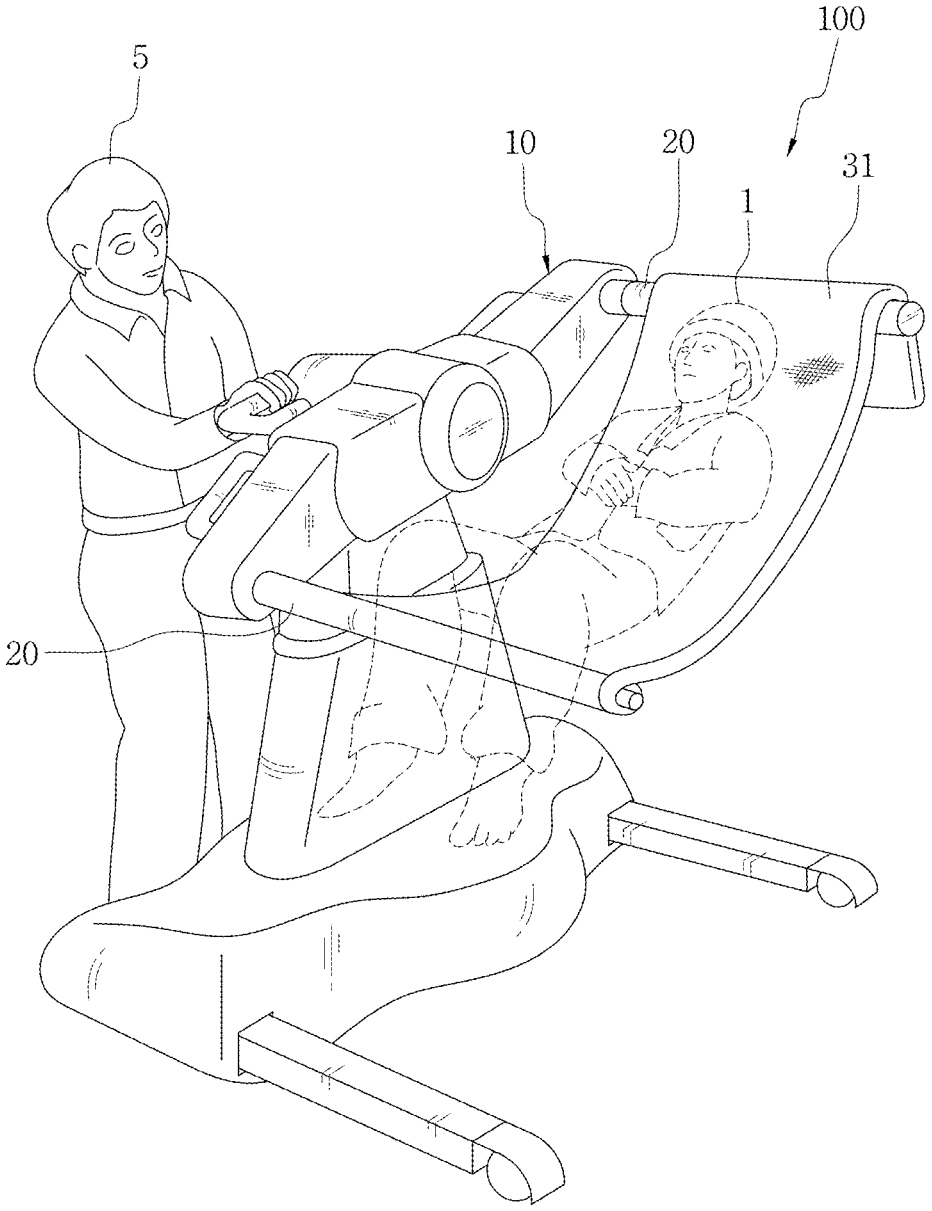
FIG. 8C is a diagram showing an example in which the smart sling device is driven by the manipulation of a caregiver.

Referring to FIG. 8C, the caregiver 5 holds the manipulation handle of the body 10 and moves the manipulation handle in parallel in a front, rear, left or right direction as desired. At this time, the patient 1 is supported by the sling member 30, and for safety while driving, the surrounding environment is recognized through a sensor of the body 10, and driving is automatically stopped in case of an unexpected situation.

Figure 8D:
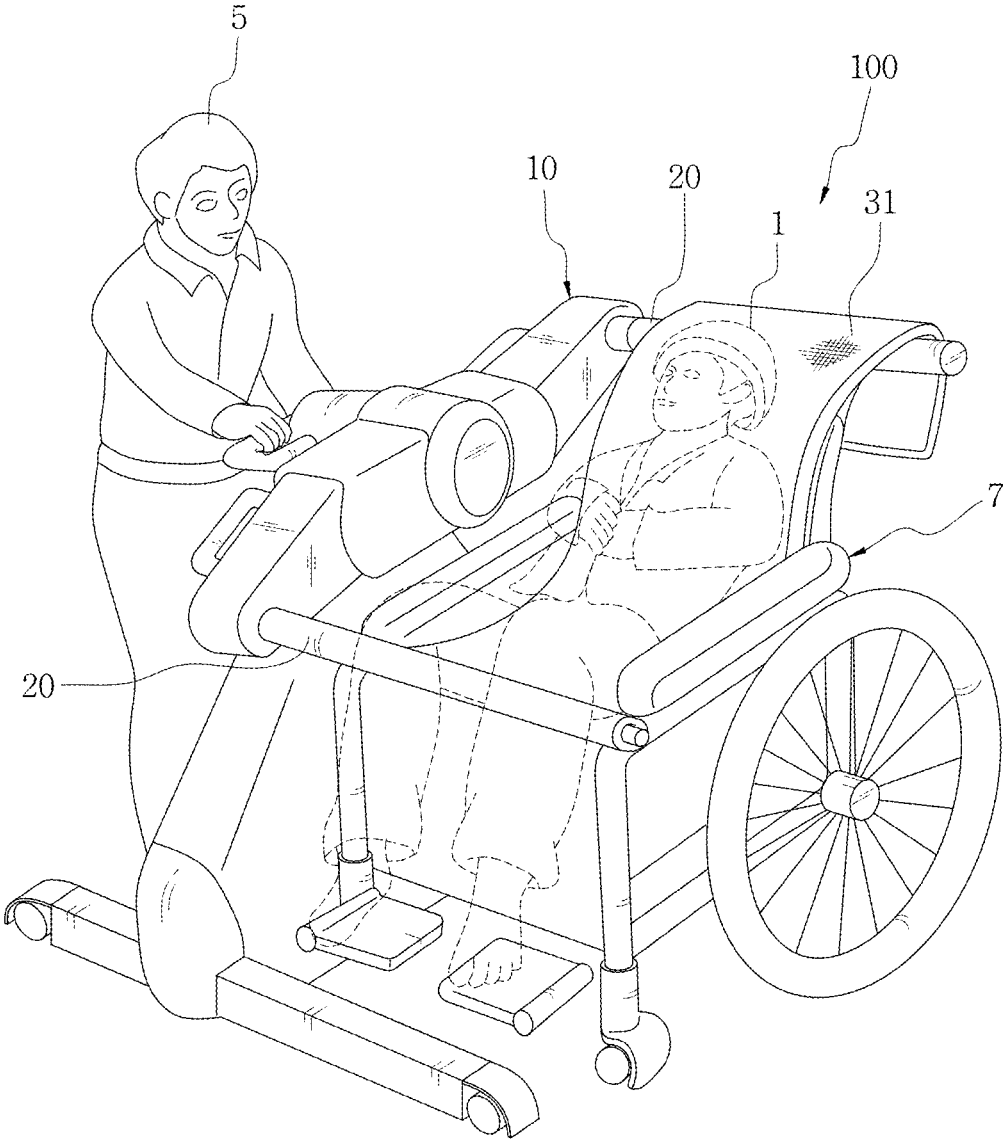
FIG. 8D is a diagram showing an example in which the patient seats on a driving target by the smart sling device.

Referring to FIG. 8D, the patient 1 supported by the sling member 30 is transferred onto a seating part of a transfer instrument such as a wheelchair 7 or chair, and the manipulation handle of the body 10 is manipulated downward so that the patient 1 seats on the seating part of the wheelchair 7.

Figure 8E:
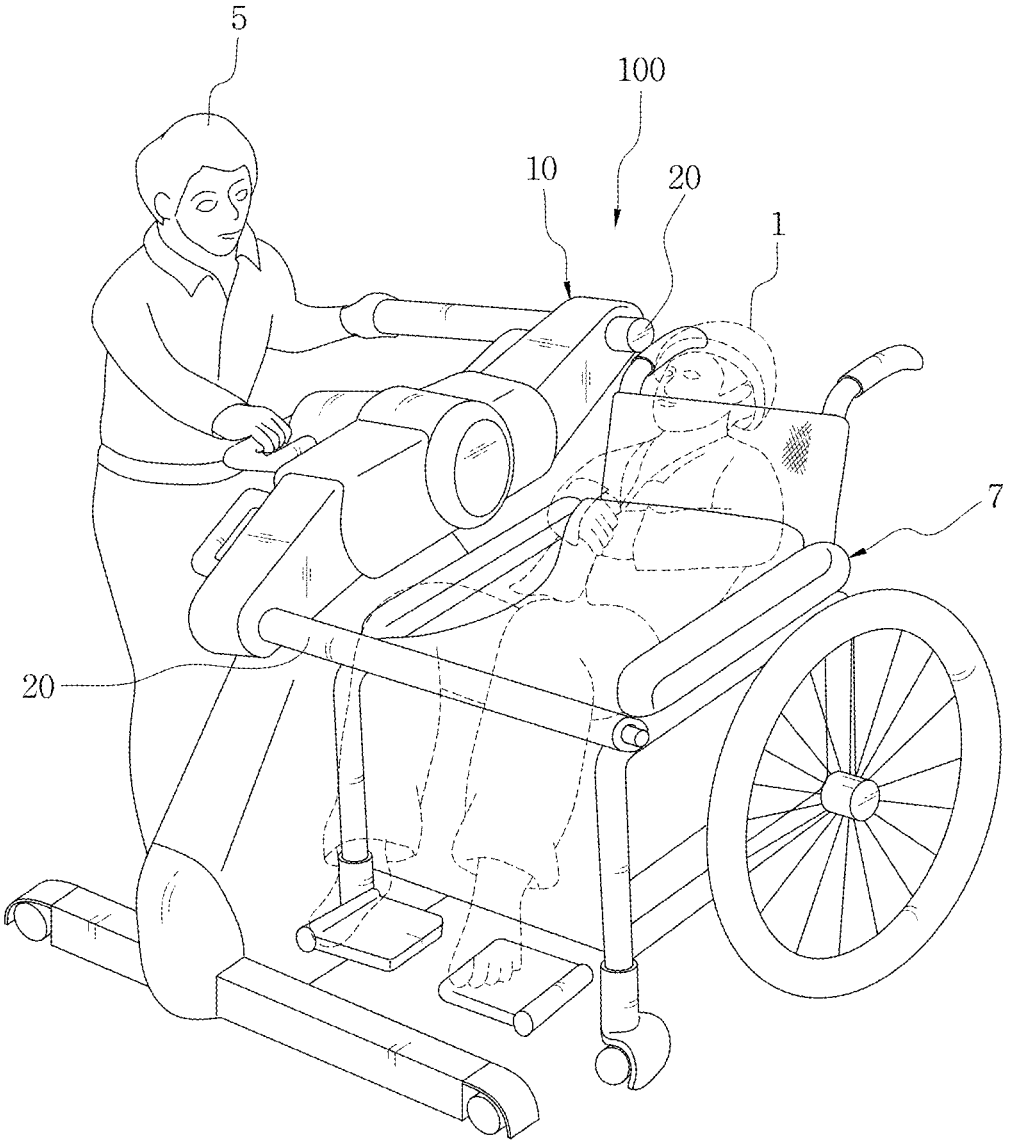
FIG. 8E is a diagram showing an example in which a support rod near the head is removed and the sling member is folded.

Referring to FIG. 8E, after the support rod 20 near the head is removed, if an operation button is pressed, air is removed from the accommodation space 32 of the sling member 30, and the sling member 30 is folded and stored to the inside of the support rod 20 near the leg.

The smart sling device 100 as described above is not limited to the configuration and method of the embodiments described above, but the embodiments may be modified in various ways by combining the embodiments entirely or selectively.

It will be apparent to those skilled in the art that the present disclosure can be embodied in other specific forms without departing from the essential characteristics of the present disclosure. Accordingly, the above detailed description should be considered in all respects as illustrative and not restrictive. The scope of the present disclosure shall be determined by rational interpretation of the appended claims, and all changes within the equivalence scope of the present disclosure shall fall within the scope of the present disclosure.

What is claimed is:

1. A smart sling device, comprising:

a body;

a support rod installed at the body; and a sling member installed at the support rod and inserted under a patient to support the patient therebelow, wherein the sling member includes:

an expanding unit having an accommodation space for accommodating air therein, the expanding unit expanding due to a pneumatic pressure generated by the accommodated air to support the patient therebelow; and at least three expansion limiting units installed at the expanding unit to limit expansion of the expanding unit in one direction, wherein the expanding unit has first and second portions formed at a front side thereof to convexly protrude in an expanding direction, wherein the at least three expansion limiting units extend in a direction intersecting with the expanding direction.

2. The smart sling device according to claim 1, wherein two support rods are provided so that the expanding unit is installed at one support rod and expands toward the other support rod by the pneumatic pressure.

3. The smart sling device according to claim 1, wherein the at least three expansion limiting units are installed at the expanding unit in a direction intersecting with the one direction.

4. The smart sling device according to claim 3, wherein the at least three expansion limiting units are installed at the expanding unit in parallel with each other.

5. The smart sling device according to claim 3, wherein the expansion limiting units are respectively installed at one surface of the expanding unit that is contactable with the patient and the other surface thereof opposite to the one surface with the accommodation space being interposed therebetween.

6. The smart sling device according to claim 3, wherein the at least three expansion limiting units are installed at a side surface of the expanding unit that is connected to one surface of the expanding unit.

7. The smart sling device according to claim 1, wherein a tension transmission member is installed inside the expanding unit to generate a tension so as to lift the patient after the expanding unit completely expands.

8. The smart sling device according to claim 1, wherein a tension transmission member is installed at an outer side of the expanding unit so that the tension transmission member applies a tension to the expanding unit when the expanding unit expands.

* * * * *